US009164468B2

(12) United States Patent
Hashimoto

(10) Patent No.: US 9,164,468 B2
(45) Date of Patent: Oct. 20, 2015

(54) POSITIONING MECHANISM FOR POSITIONING DRAWER RELATIVE TO CASING OF IMAGE FORMING DEVICE

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/272,955

(22) Filed: May 8, 2014

(65) Prior Publication Data

US 2014/0334841 A1 Nov. 13, 2014

(30) Foreign Application Priority Data

May 9, 2013 (JP) ..... 2013-099593

(51) Int. Cl.
*G03G 21/16* (2006.01)

(52) U.S. Cl.
CPC ..... *G03G 21/16* (2013.01)

(58) Field of Classification Search
CPC .... G03G 21/1821; G03G 21/16; G03G 15/00
See application file for complete search history.

(56) References Cited

U.S. PATENT DOCUMENTS

| | | | | |
|---|---|---|---|---|
| 8,175,491 | B2 | 5/2012 | Tomatsu et al. | |
| 8,774,671 | B2 * | 7/2014 | Okabe | 399/90 |
| 2007/0147885 | A1 | 6/2007 | Okabe et al. | |
| 2008/0003015 | A1 * | 1/2008 | Tomatsu | 399/110 |
| 2010/0014887 | A1 | 1/2010 | Tomatsu et al. | |
| 2010/0104311 | A1 * | 4/2010 | Okamoto | 399/75 |
| 2010/0135697 | A1 * | 6/2010 | Hashimoto | 399/117 |
| 2010/0166457 | A1 * | 7/2010 | Hashimoto | 399/117 |
| 2011/0064462 | A1 * | 3/2011 | Abe et al. | 399/117 |
| 2011/0229194 | A1 * | 9/2011 | Okabe et al. | 399/110 |
| 2012/0230729 | A1 | 9/2012 | Abe | |
| 2012/0251163 | A1 * | 10/2012 | Tomatsu et al. | 399/110 |
| 2013/0051847 | A1 * | 2/2013 | Kamimura | 399/111 |
| 2014/0010574 | A1 | 1/2014 | Okabe et al. | |
| 2014/0169828 | A1 * | 6/2014 | OHTA et al. | 399/110 |

FOREIGN PATENT DOCUMENTS

| | | | |
|---|---|---|---|
| JP | 2006301441 | A | * 11/2006 |
| JP | 2007-178657 | A | 7/2007 |
| JP | 2009-014955 | A | 1/2009 |
| JP | 2010-044363 | A | 2/2010 |
| JP | 2012-189619 | A | 10/2012 |

* cited by examiner

*Primary Examiner* — Clayton E Laballe
*Assistant Examiner* — Ruifeng Pu
(74) *Attorney, Agent, or Firm* — Banner & Witcoff, Ltd.

(57) ABSTRACT

An image forming device includes a main casing, a unit, a side plate, a positioning member, and a fixing member. The side plate is formed with a through-hole having a first surface extending in a second direction crossing a first direction, a second surface extending in a third direction crossing the first direction and the second direction, and a third surface, and a fourth surface positioned between the first surface and the second surface in a contour of the through hole. The positioning member is in contact with the first surface and the second surface. The third surface is positioned opposite to the fourth surface with respect to the positioning member. The fixing member includes an insert portion configured to be inserted through the through-hole. The insert portion is positioned between the first portion and the third surface to press the first portion toward the fourth surface.

27 Claims, 12 Drawing Sheets

POSITIONING MECHANISM FOR POSITIONING DRAWER RELATIVE TO CASING OF IMAGE FORMING DEVICE

CROSS REFERENCE TO RELATED APPLICATION

This application claims priority from Japanese Patent Application No. 2013-099593 filed May 9, 2013, the entire content of which is incorporated herein by reference.

TECHNICAL FIELD

The present invention relates to an image forming device and a positioning mechanism used therein for positioning a drawer.

BACKGROUND

Japanese Patent Application Publication No. 2010-44363 discloses a tandem type color printer in which a plurality of cartridges is detachably attached to a main casing. In such a type of color printer, a drawer unit and a positioning mechanism are provided. The drawer unit is configured to receive a plurality of cartridges, and can be pulled out of and pushed into a main frame. The drawer unit is subjected to positioning at a predetermined position in the main frame by the positioning mechanism.

SUMMARY

The positioning mechanism includes side plates and a shaft member. Each side plate extends in a push-in pull-out direction of the drawer unit, and is formed with a rectangular hole. The shaft member extends in a direction perpendicular to the push-in pull-out direction, and has each axial end portion inserted into each hole. Thus, the shaft member is fixed in the main frame. Further, the shaft member is positioned at far side relative to the drawer unit, i.e., in front of the drawer unit in the push-in direction thereof. As a result of push-in operation of the drawer unit into the main casing, the drawer unit is brought into abutment with a peripheral surface of the shaft member, thereby positioning at a predetermined position.

The side plate is provided with a spring for urging the shaft member. Thus, the shaft member is pressed against a part of an inner surface of the hole by the urging force of the spring. Accordingly, the shaft member is subjected to positioning with respect to the main frame, and accordingly, to the main casing.

It is conceivable that a gap may be provided between the shaft member and another part of the inner surface of the hole due to the urging force, the other part being opposite, with respect to the shaft member, to the part of the inner surface in contact with the shaft member. Therefore, rattling of the shaft member may occur due to application of impact force to the shaft member. As a result, rattling may also occur in the drawer unit and cartridges assembled therein.

In view of the foregoing, it is an object of the invention to provide an image forming device and a positioning device used therein capable of secure positioning to a drawer unit.

In order to attain the above and other objects, the invention provides an image forming device. The image forming device includes a main casing, a unit for image formation, a side plate, a positioning member, and a fixing member. The side plate is fixed in the main casing and positioned spaced away from the unit in a first direction. The side plate is formed with a through-hole having a first surface extending in a second direction crossing the first direction, a second surface extending in a third direction crossing the first direction and the second direction, a third surface, and a fourth surface positioned between the first surface and the second surface in a contour of the through hole. The positioning member extends in the first direction and includes a first portion inserted through the through-hole and a second portion configured to be in abutment with the unit. The first portion is contact with the first surface and the second surface. The third surface is positioned opposite to the fourth surface with respect to the first portion. The fixing member includes an insert portion configured to be inserted through the through-hole. The insert portion is positioned between the first portion and the third surface to press the first portion toward the fourth surface.

According to another aspect, the present invention provides a positioning mechanism. The positioning mechanism is configured to perform positioning of a unit for image formation relative to a main casing. The positioning mechanism includes a side plate, a positioning member, and a fixing member. The side plate is fixed in the main casing and positioned spaced away from the unit in a first direction. The side plate is formed with a through-hole having a first surface extending in a second direction crossing the first direction, a second surface extending in a third direction crossing the first direction and the second direction, a third surface, and a fourth surface positioned between the first surface and the second surface in a contour of the through hole. The positioning member extends in the first direction and includes a first portion inserted through the through-hole and a second portion configured to be in abutment with the unit. The first portion is in contact with the first surface and the second surface. The third surface is positioned opposite to the fourth surface with respect to the first portion. The fixing member includes an insert portion configured to be inserted through the through-hole. The insert portion is positioned between the first portion and the third surface to press the first portion toward the fourth surface.

DETAILED DESCRIPTION

1. Overall Structure of Printer

A printer 1 as an example of an image forming device is a direct tandem color laser printer of a horizontal type. The printer 1 includes a main casing 2 for accommodating therein a supply unit 3 adapted to supply a sheet P and an image forming unit 4 adapted to form an image on the supplied sheet P.

Figure 1:
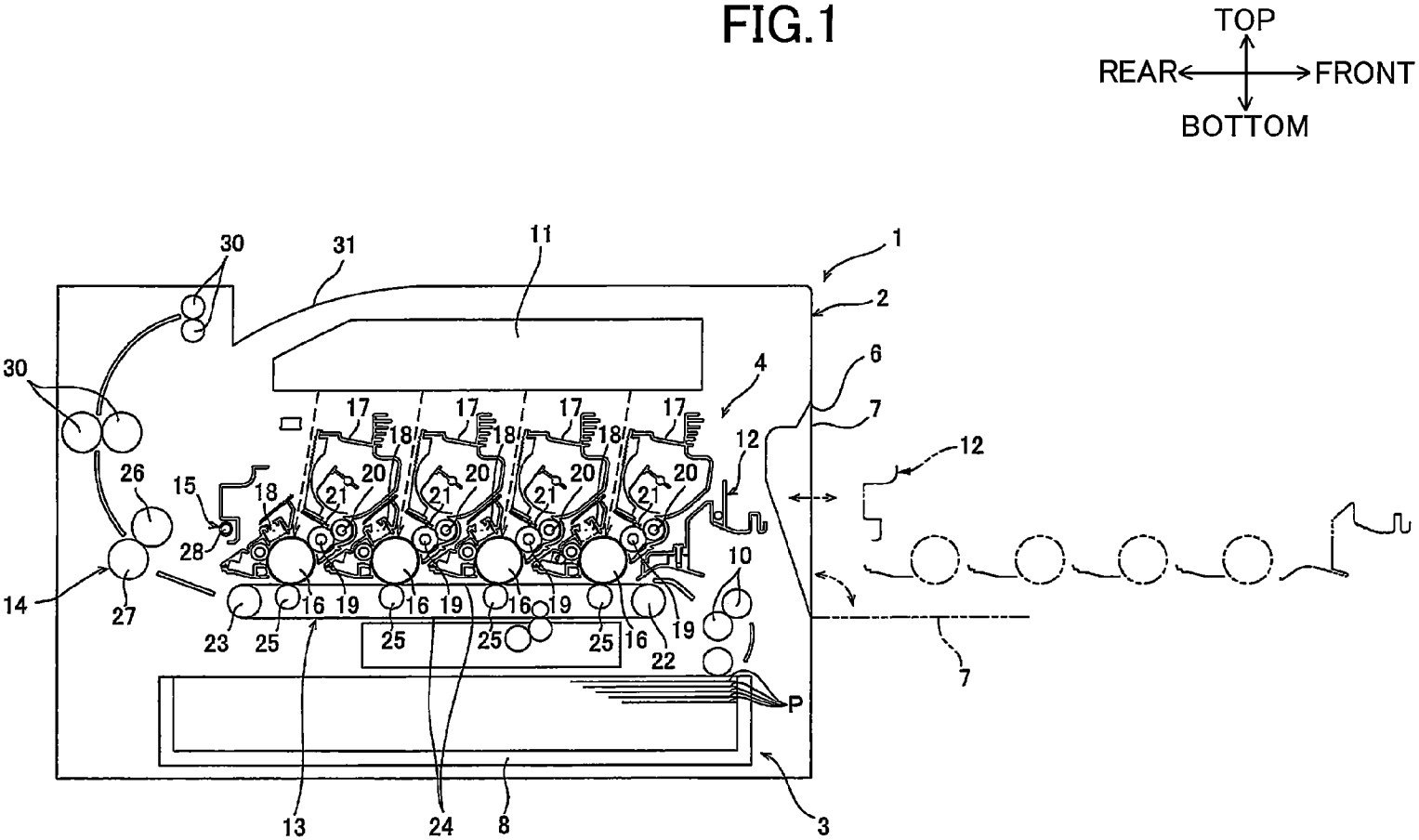
FIG. 1 is a cross-sectional side view of a printer as an example of an image forming device according to one embodiment of the present invention.

In the following description, the expressions "top", "bottom", "front", and "rear" are used herein to define the various parts when the printer 1 is rested on a horizontal plane. That is, an upper side in FIG. 1 is "top", a lower side in FIG. 1 "bottom", a right side in FIG. 1 "front", and a left side in FIG. 1 "rear". The expressions "right" and "left" are defined when the printer 1 is viewed from the front side. That is, a near side in FIG. 1 is "left", and a far side in FIG. 1 "right". The rightward/leftward direction is an example of a first direction, and the frontward/rearward direction is an example of a second direction.

(1-1) Main Casing

The main casing 2 has a substantially rectangular box shape in a side view for accommodating therein the supply unit 3 and the image forming unit 4. The main casing 2 includes a front cover 7 and has a front wall formed with an opening 6. The front cover 7 is pivotally movable about its lower end between a closed position for closing the opening 6 as depicted in solid line in FIG. 1 and an open position for opening the opening 6 as depicted in two-dotted chain line in FIG. 1.

(1-2) Supply Unit

The supply unit 3 includes a sheet supply tray 8 and a pair of registration rollers 10. The sheet supply tray 8 is detachably mounted on a lower portion of the main casing 2 for accommodating therein a stack of sheets P.

(1-3) Image Forming Unit

The image forming unit 4 includes a scanner unit 11, a drawer unit 12, a transfer unit 13, and a fixing unit 14.

(1-3-1) Scanner Unit

The scanner unit 11 is positioned at the upper portion of the main casing 2. The scanner unit 11 is adapted to emit laser beams toward each of four photosensitive drums 16 based on an image data to expose each photosensitive drum 16.

(1-3-2) Drawer Unit

The drawer unit 12 is positioned at substantially center portion in the vertical direction and below the scanner unit 11. The drawer unit 12 includes a plurality of, i.e., four, process cartridges 17 for each color. The drawer unit 12 is movable along the frontward/rearward direction between an inside position within the main casing 2 as depicted in the solid line in FIG. 1 and an outside position outside of the main casing 2 as depicted in the two-dotted chain line in FIG. 1.

Each of the plurality of process cartridges 17 is juxtaposed in frontward/rearward direction at intervals, and accommodated so as to be attachable to and detachable from the drawer unit 12. For example, the plurality of process cartridges 17 accommodates therein black, yellow, cyan, and magenta toner from front to rear.

Each of the plurality of process cartridges 17 includes the photosensitive drum 16, a scorotron-type charger 18, a developing roller 19, a supply roller 20, and thickness regulating blade 21.

The photosensitive drum 16 is a substantially cylindrical shape elongated in rightward/leftward direction. The photosensitive drum 16 is rotatably supported so as to be partially exposed downward from the lower end portion of the process cartridge 17.

The charger 18 is positioned diagonally above and rearward of the photosensitive drum 16.

The developing roller 19 is substantially cylindrical shape elongated in the rightward/leftward direction. The developing roller 19 is rotatably supported on the process cartridge 17 so as to be in contact with the upper front portion of the photosensitive drum 16.

The supply roller 20 is substantially cylindrical shape elongated in the rightward/leftward direction. The supply roller 20 is rotatably supported on the process cartridge 17 so as to be in contact with the upper front portion of the developing roller 19.

The thickness regulating blade 21 is supported on the process cartridge 17 so as to be in sliding contact with the upper portion of the developing roller 19.

(1-3-3) Transfer Unit

The transfer unit 13 is positioned above the supply unit 3 and below the drawer unit 12 along the frontward/rearward direction in the main casing 2. The transfer unit 13 includes a drive roller 22, a follower roller 23, a conveyance belt 24, and a plurality of, i.e., four, transfer rollers 25.

The drive roller 22 is a substantially cylindrical shape elongated in the rightward/leftward direction and positioned below the front portion of the drawer unit 12.

The follower roller 23 is a substantially cylindrical shape elongated in the rightward/leftward direction and positioned below the rear portion of the drawer unit 12.

The conveyance belt 24 is stretched taut about the drive roller 22 and the follower roller 23.

Each of the plurality of transfer rollers 25 is opposite to each of the plurality of photosensitive drums 16 with the upper portion of the conveyance belt 24 interposed therebetween and positioned below the corresponding photosensitive drums 16. The transfer roller 25 is a substantially cylindrical shape elongated in the rightward/leftward direction.

(1-3-4) Fixing Unit

The fixing unit 14 is positioned rearward of the transfer unit 13 and includes a heat roller 26 and a pressure roller 27 disposed obliquely lower rearward of the heat roller 26.

2. Operation of Printer

The sheet P accommodated in the sheet supply tray 8 is fed one-by-one between the pair of registration rollers 10 along U-shaped path leading upward, and conveyed between the photosensitive drum 16 of the image forming unit 4 and the conveyance belt 24 at a predetermined timing.

The toner accommodated in the process cartridge 17 is supplied to the supply roller 20, supplied to the developing roller 19, and then positively tribocharged between the supply roller 20 and the developing roller 19.

The toner supplied to the developing roller 19 is regulated by the thickness regulating blade 21 as the rotation of the developing roller 19, forming a uniform thin-layer thereon.

The charger 18 positively and uniformly charges the peripheral surface of the photosensitive drum 16 as the rotation of the same. After that, the scanner unit 11 emits the laser beam for exposing the peripheral surface at high-speed scan, thereby forming on the peripheral surface of the photosensitive drum 16 an electrostatic latent image corresponding to an image to be formed on the sheet P.

The positively charged toner carried on the peripheral surface of the developing roller 19 is supplied on the electrostatic latent image formed on the peripheral surface of the photosensitive drum 16 as the rotation of the photosensitive drum 16, thereby forming toner image on the peripheral surface of the photosensitive drum 16 due to a reversal phenomenon.

The sheet P discharged from the supply unit 3 is conveyed by the conveyance belt 24 and passes through a transfer position between each photosensitive drum 16 and each transfer roller 25 from front to rear. Each toner image carried on each photosensitive drum 16 is sequentially transferred and superimposed on the sheet P during the conveyance of the sheet P.

The toner image transferred on the sheet P is fixed thereon by heat and pressure while the sheet P passes between the heat roller 26 and the pressure roller 27.

The sheet P having the thermally fixed toner image is guided by a discharge guide (not shown), is turned to forward along U-shaped path, passes between each pair of discharge rollers 30, and then is discharged onto a discharge tray 31.

3. Drawer Unit

Figure 2:
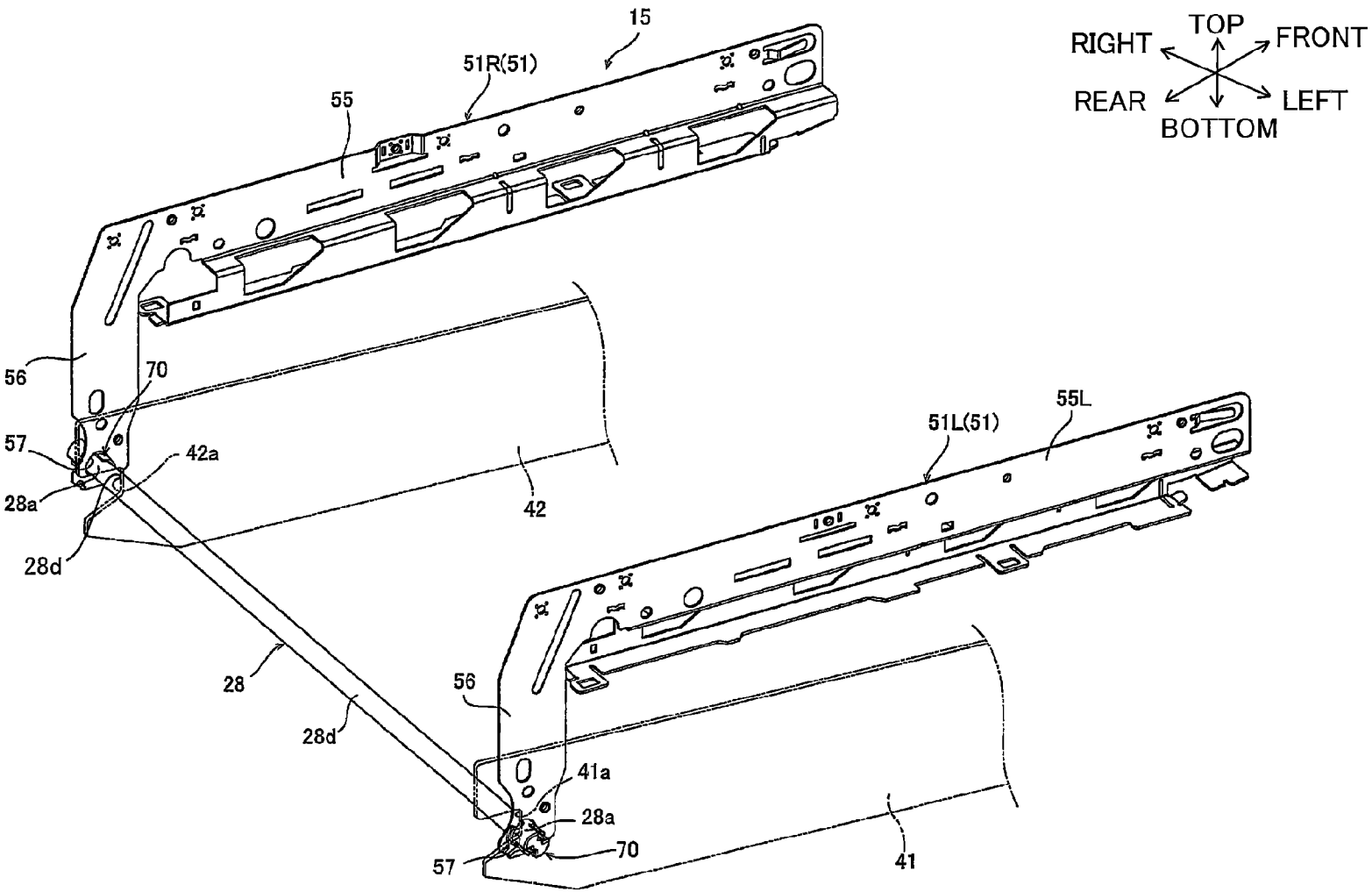
FIG. 2 is a perspective view of a positioning mechanism incorporated in the printer of FIG. 1.
Figure 3:
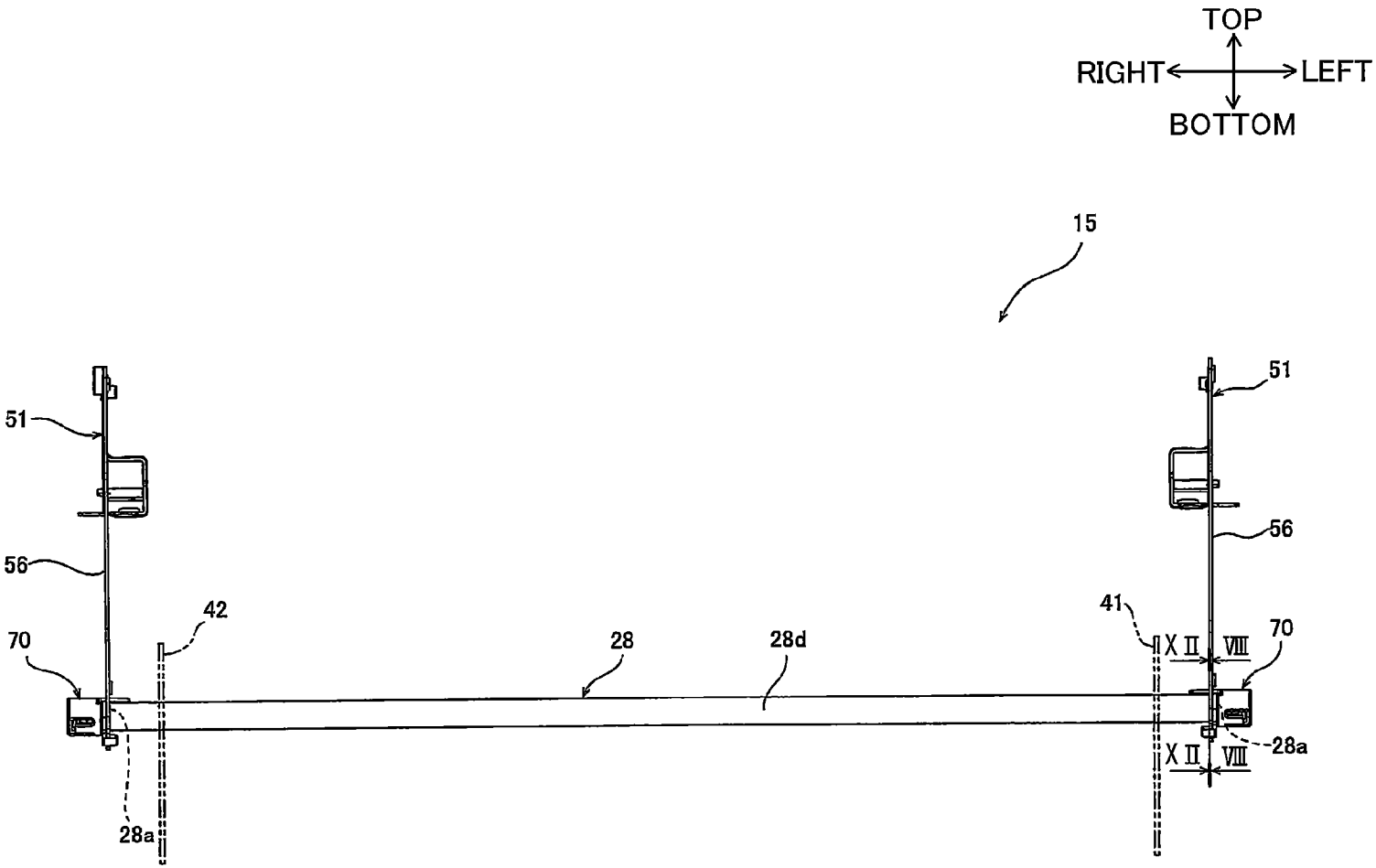
FIG. 3 is rear view of the positioning mechanism according to the embodiment.

As shown in FIGS. 2 and 3, the drawer unit 12 includes a left side plate 41 and a right side plate 42 those constituting a drawer frame. The left side plate 41 is elongated rectangular shaped in side view extending in frontward/rearward direction, and has a rear end face functioning as a left abutment portion 41*a* recessed frontward in squared U-shape.

The right side plate 42 is elongated rectangular shaped in side view extending in frontward/rearward direction, and has a rear end face functioning as a right abutment portion 42*a* recessed frontward in squared U-shape. The right side plate 42 is positioned rightward of the left side plate 41 and is spaced away therefrom in rightward/leftward direction.

4. Details of Main Casing

The main casing 2 includes a positioning mechanism 15 positioned above and rearward of the drawer unit 12.

Figure 4:
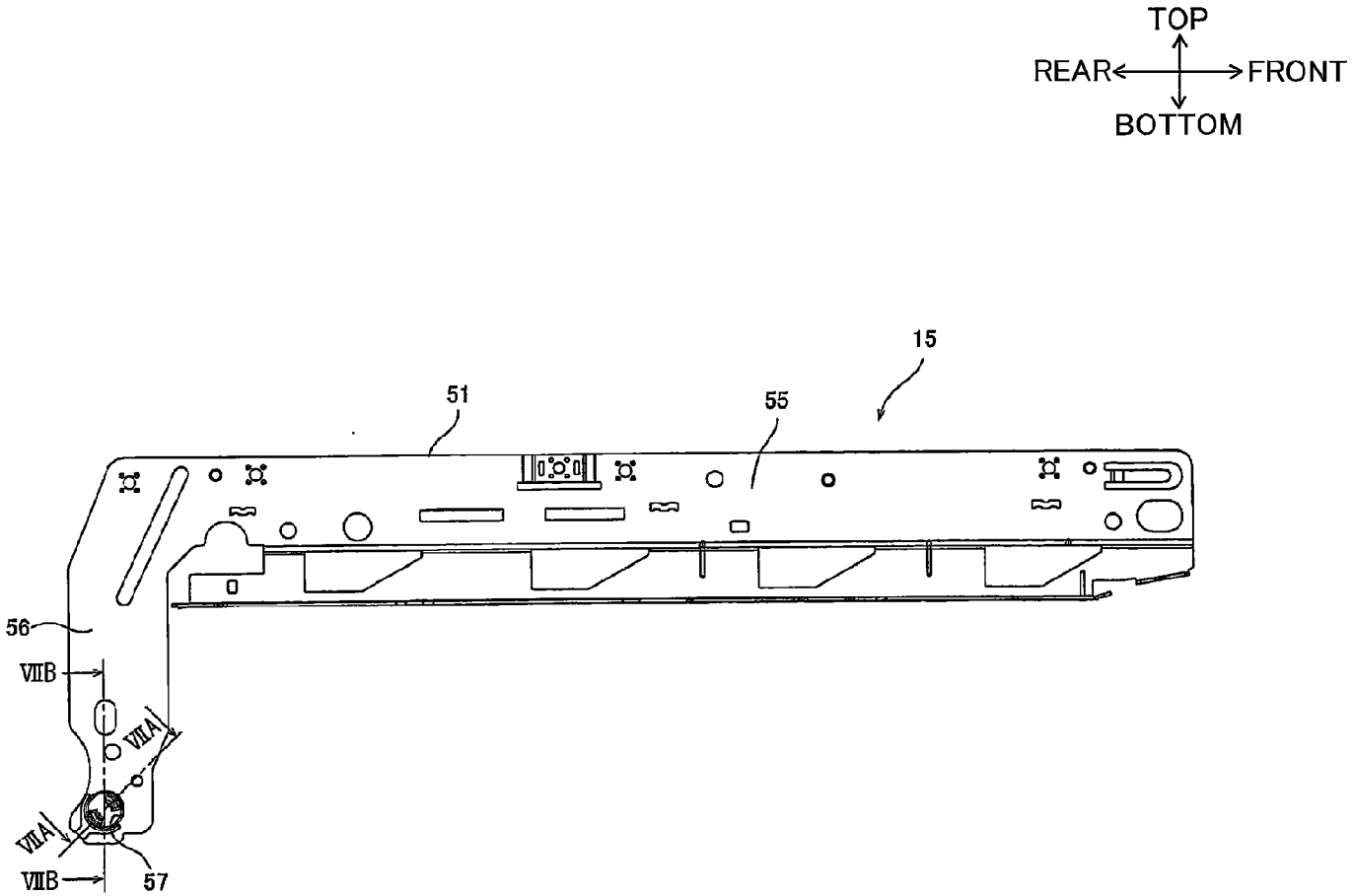
FIG. 4 is a left side view of the positioning mechanism according to the embodiment.
Figure 5A:
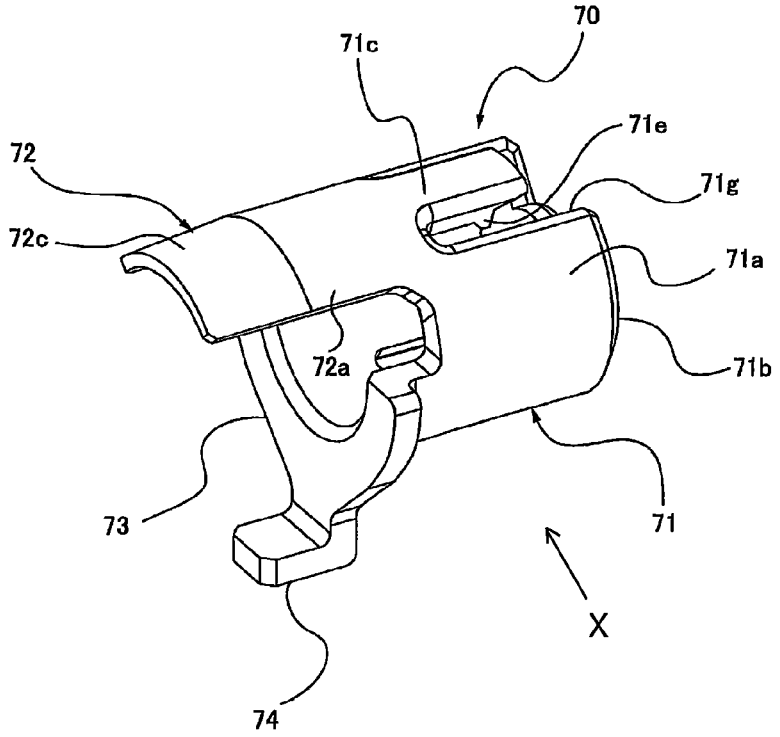
FIG. 5A is a perspective view of a fixing member including a sleeve portion in the positioning mechanism according to the embodiment.
Figure 5B:
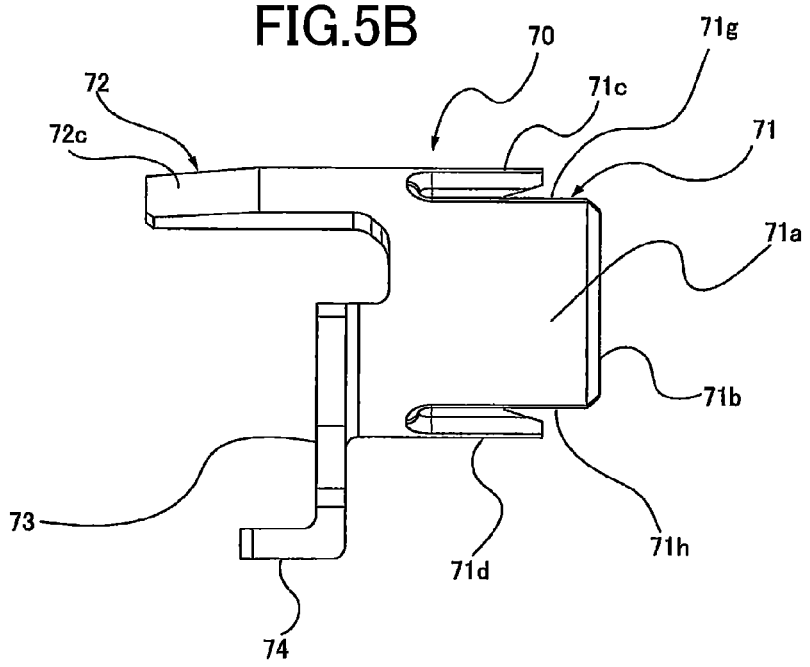
FIG. 5B is a view of the fixing member as viewed in a direction indicated by an arrow X in FIG. 5A.

As shown in FIGS. 2, 3 and 4, the positioning mechanism 15 includes a pair of positioning side plates 51 (as an example of a side plate), a positioning shaft 28 (as an example of a positioning member), and a pair of fixing members 70.

The pair of positioning side plates 51 includes a left positioning side plate 51L positioned leftward in the main casing, and a right positioning side plate 51R positioned rightward of the left positioning side plate 51L and spaced away therefrom in rightward/leftward direction.

In the following description, portions identical to each other between the left and right positioning plates 51L and 51R will be described as portions of the positioning side plate 51.

(4-1) Positioning Side Plate

The positioning side plate 51 is L-shaped in side view and extends in frontward/rearward direction, and includes a horizontal plate portion 55 and a vertical plate portion 56. The positioning side plate 51 is fixed to the main casing 2, such that the positioning side plate 51 is spaced away from the left side plate 41 and the right side plate 42 of the drawer unit 12. That is, the left positioning side plate 51L is positioned leftward of the left side plate 41 of the drawer unit 12, and the right positioning side plate 51R is positioned rightward of the right side plate 42 of the drawer unit 12.

The horizontal plate portion 55 is elongated rectangular plate shaped extending in frontward/rearward direction.

Figure 8:
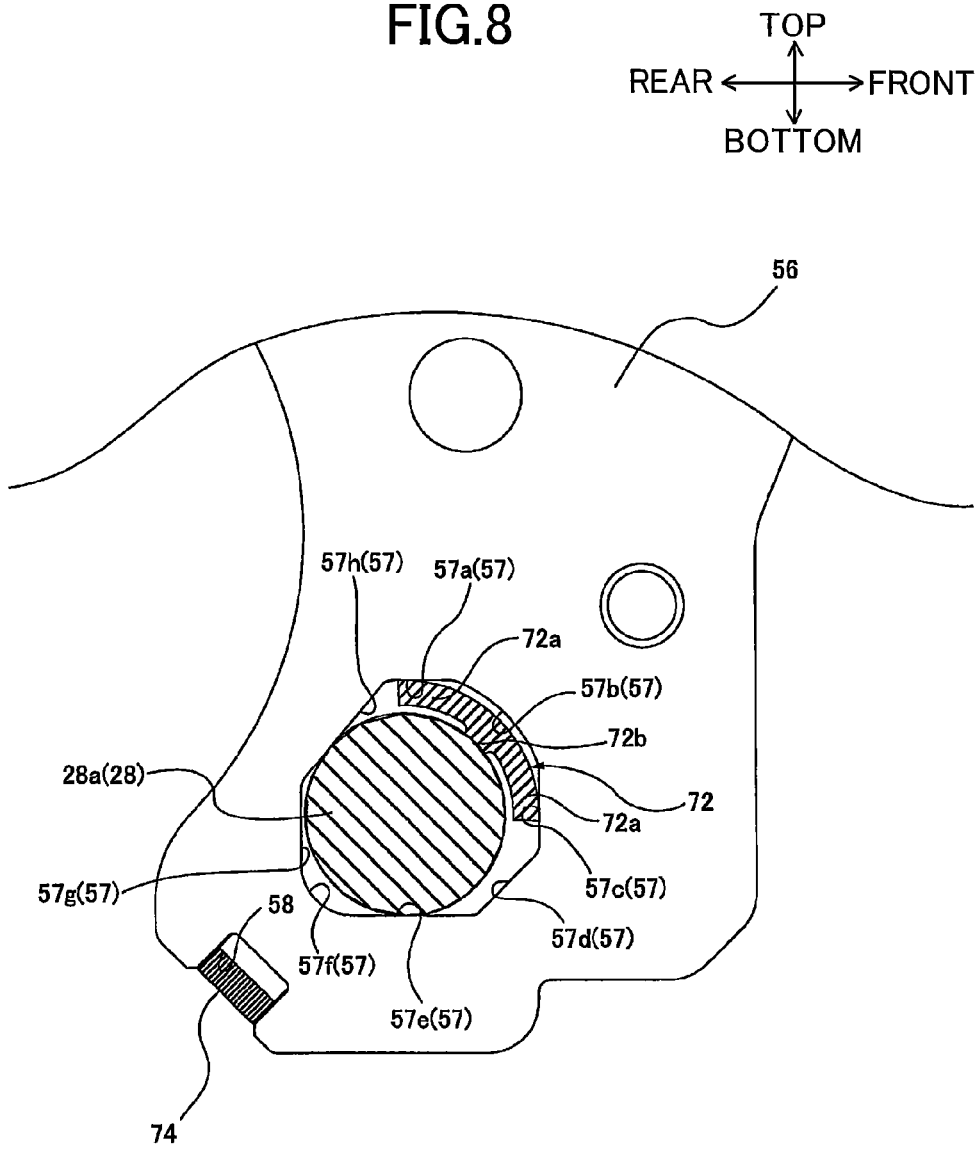
FIG. 8 is a partial cross-sectional view of the positioning mechanism taken along the line VIII-VIII of FIG. 3.

The vertical plate portion 56 is elongated rectangular plate shaped extending downward from a rear end portion of the horizontal plate portion 55, and has a lower end portion formed with a through-hole 57. As shown in FIG. 8, the vertical plate portion 56 has a rear lower end portion formed with an engagement portion 58 recessed diagonally upward and frontward.

(4-2) Through-Hole

As shown in FIG. 8, the through-hole 57 is generally circular in side view, and includes an upper inner surface portion 57*a*, a diagonally upper front inner surface portion 57*b*, a front inner surface portion 57*c*, a diagonally lower front inner surface portion 57*d*, a lower inner surface portion 57*e*, a diagonally lower rear inner surface portion 57*f*, a rear inner surface portion 57*g*, and a diagonally upper rear inner surface portion 57*h*.

The upper inner surface portion 57*a* is an example of a third surface, and extends linearly in frontward/rearward direction.

The diagonally upper front surface portion 57*b* is an example of the third surface, and extends diagonally downward in a curved manner from a front end of the upper inner surface portion 57*a*.

The front inner surface portion 57*c* is an example of the third surface and extends linearly downward from a lower end of the diagonally upper front surface portion 57*b*.

The diagonally lower front inner surface portion 57*d* linearly extends diagonally downward and rearward from a lower end of the front inner surface portion 57*c*.

The lower inner surface portion 57*e* is an example of a first surface, and linearly extends rearward from a lower end of the diagonally lower front inner surface portion 57*d*. That is, the lower inner surface portion 57*e* extends in frontward/rearward direction.

The diagonally lower rear inner surface portion 57*f* extends diagonally upward and rearward from a rear end of the lower inner surface portion 57*e* in a curved manner.

The rear inner surface portion 57*g* is an example of a fourth surface and linearly extends upward from an upper end of the diagonally lower rear inner surface portion 57*f*.

The diagonally upper rear inner surface portion 57*h* is an example of a second surface, and linearly extends diagonally upward and frontward from an upper end of the rear inner surface portion 57*g*. The diagonally upper rear inner surface portion 57*h* has an upper end connected to a rear end of the upper inner surface portion 57*a*. That is, the diagonally upper rear inner surface portion 57*h* extends in a direction crossing the rightward/leftward direction and frontward/rearward direction. Such extending direction of the diagonally upper rear inner surface portion 57*h* is an example of a third direction.

As described later, the positioning shaft 28 has a supported portion 28*a* inserted through the through-hole 57. The lower inner surface portion 57*e* and the rear inner surface portion 57*g* are spaced away from and opposite to the upper inner surface portion 57*a*, the diagonally upper front surface portion 57*b*, and the front inner surface portion 57*c* with respect to the supported portion 28*a*. The diagonally upper rear inner surface portion 57*h* is positioned in the contour of the through-hole 57 between the upper inner surface portion 57*a* and the lower inner surface portion 57*e*.

(4-3) Positioning Shaft

Figure 7A:
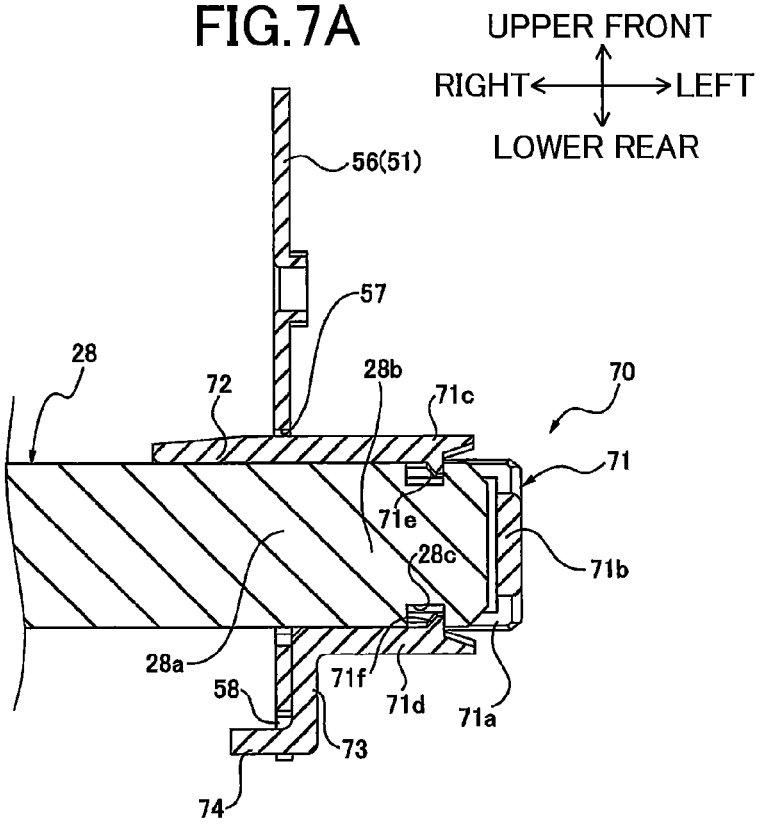
FIG. 7A is a cross-sectional view of a part of the positioning mechanism taken along the line VIIA-VIIA of FIG. 4 and viewed from a position diagonally upward and rearward relative to the line VIIA-VIIA.
Figure 7B:
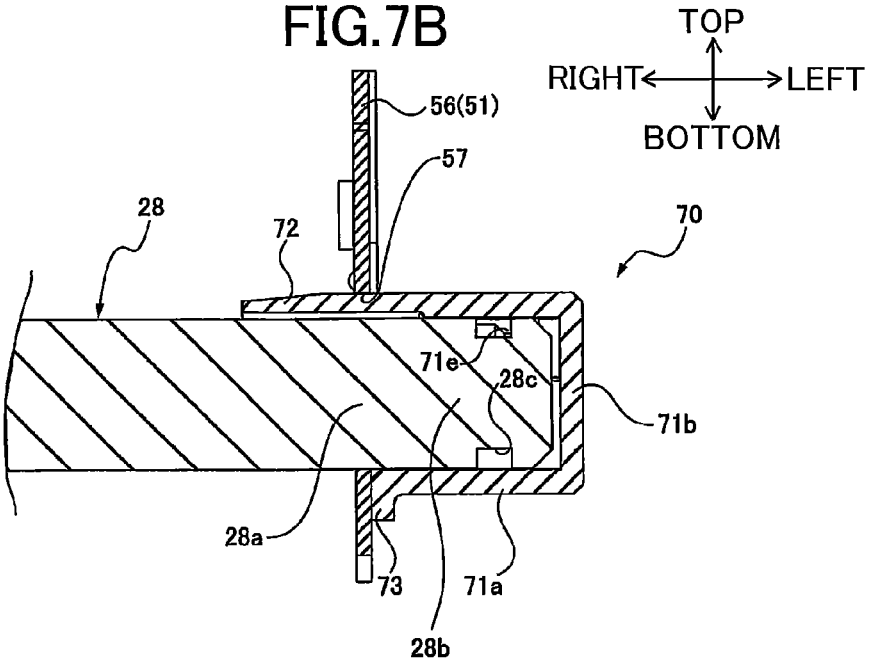
FIG. 7B is a cross-sectional view of the part of the positioning mechanism taken along the line VIIB-VIIB of FIG. 4 and viewed from a position rearward relative to the line VIIB-VIIB.

As shown in FIG. 2, the positioning shaft 28 is generally cylindrical and extends in rightward/leftward direction (as an example of a first direction). As shown in FIGS. 7A and 7B, the positioning shaft 28 has an outer diameter smaller than an inner diameter of the through-hole 57, and is formed with an engagement groove 28*c*.

As shown in FIGS. 7A and 7B, the positioning shaft 28 has an end portion inserted through the through-hole 57. The supported portion 28*a* is a portion generally aligned with the vertical plate portion 56 in rightward/leftward direction as an example of a first portion.

The positioning shaft 28 has a shaft end portion 28*b* continuous with the supported portion 28*a* and positioned outward thereof in an axial direction of the positioning shaft 28. The shaft end portion 28*b* has an outer peripheral surface where the engagement groove 28*c* is formed. The engagement groove 28*c* is in a form of an annular groove and is an example of a second engagement portion. The shaft end portion 28*b* is an example of a third portion.

The positioning shaft 28 has a shaft abutment portion 28*d* continuous with the supported portion 28*a* and positioned inward thereof in the axial direction of the positioning shaft 28. The shaft abutment portion 28*d* is configured to be brought into abutment with the left abutment portion 41*a* and the right abutment portion 42*a* of the drawer unit 12. The shaft abutment portion 28*d* is an example of a second portion.

(4-4) Fixing Member

As shown in FIGS. 5A through 7B, the fixing member 70 includes a fitting portion 71, an insert portion 72, a restriction portion 73 and a fixing portion 74.

The fitting portion 71 includes a sleeve portion 71*a*, an end portion 71*b*, a first engagement protrusion 71*c* as an example of a first engagement portion, and a second engagement protrusion 71*d*.

The sleeve portion 71*a* is generally hollow cylindrical with a partially cut-away portion. More specifically, the sleeve portion 71*a* is formed with a first recessed portion 71*g* and a second recessed portion 71*h* those extending from one end to another end of the sleeve portion 71*a* in an axial direction thereof. The first and second recessed portions 71*g* and 71*h* are formed at positions diametrically opposite to each other with respect to a center axis of the sleeve portion 71*a*.

The end portion 71*b* is generally circular with a partially cut-away portion, and is positioned at the one end of the sleeve portion 71*a* for closing the one end. More specifically, the end portion 71*b* is formed with a third recessed portion 71*i* and a fourth recessed portion 71*j* recessed radially inward from a peripheral end of the end portion 71*b* such that the third and fourth recessed portions 71*i*, 71*j* provide a generally sector shape. The third and fourth recessed portions 71*i* and 71*j* are formed at positions diametrically opposite to each other with respect to a center of the end portion 71*b*.

The third recessed portion 71*i* of the end portion 71*b* is in alignment with the first recessed portion 71*g* of the sleeve portion 71*a* in rightward/leftward direction, and the fourth recessed portion 71*j* of the end portion 71*b* is in alignment with the second recessed portion 71*h* of the sleeve portion 71*a* in rightward/leftward direction when projected in the axial direction of the sleeve portion 71*a*.

The first engagement protrusion 71*c* is positioned in the first recessed portion 71*g* and protrudes in a direction from the other end to the one end of the sleeve portion 71*a*. A first engagement pawl 71*e* protrudes radially inwardly from the first engagement protrusion 71*c*.

The second engagement protrusion 71*d* is positioned in the second recessed portion 71*h* and protrudes in a direction from the other end to the one end of the sleeve portion 71*a*. A second engagement pawl 71*f* protrudes radially inwardly from the second engagement protrusion 71*d*.

The insert portion 72 extends from the other end of the sleeve portion 71*a* in a direction away from the end portion 71*b* and in the axial direction of the sleeve portion 71*a*. The insert portion 72 has an inclined portion 72*c* approaching the axis of the sleeve portion 71*a* with distance from a base end of the insert portion 72. The insert portion 72 has an arcuate shape, and is aligned with the first engagement protrusion 71*c* as viewed from a tip end toward the base end of the insert portion 72. Further, the insert portion 72 has a pair of first contact portions 72*a* and a second contact portion 72*b*.

Each first contact portion 72*a* is positioned at each end portion of the insert portion 72 in a circumferential direction of the sleeve portion 71*a* as viewed from the tip end toward the base end of the insert portion 72. Further, each first contact portion 72*a* is positioned midway from the base end to the tip end of the insert portion 72 in the extending direction thereof.

The second contact portion 72*b* protrudes toward the axis of the sleeve portion 71*a* from an inner surface of the insert portion 72, and is positioned at a center between the pair of first contact portions 72*a* as viewed from the tip end toward the base end of the insert portion 72.

The restriction portion 73 protrudes from the other end of the sleeve portion 71*a* in a direction away from the end portion 71*b* and in the axial direction of the sleeve portion 71*a*, and is then bent in a radially outward direction of the sleeve portion 71*a*. Further, the restriction portion 73 is semicircular ring shaped and is positioned opposite to the insert portion 72 with respect to the axis of the sleeve portion 71*a* as viewed from the tip end toward the base end of the insert portion 72.

The fixing portion 74 protrudes in a radially outward direction of the sleeve portion 71*a* from a center portion of the restriction portion 73 in the circumferential direction, and is then protrudes in a direction away from the end portion 71*b* in the axial direction of the sleeve portion 71*a*.

Figure 6A:
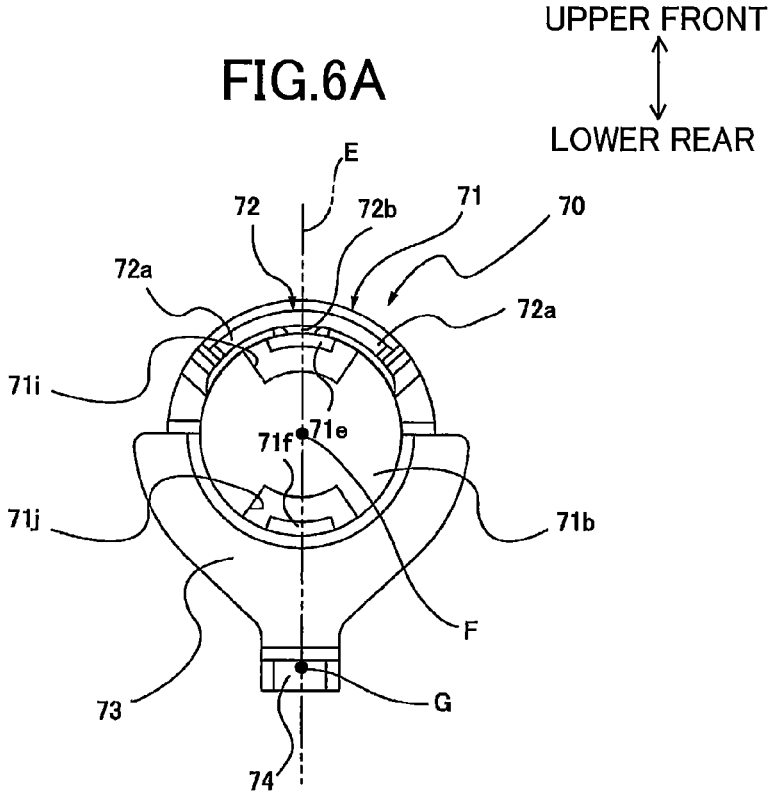
FIG. 6A is a view of the fixing member as viewed from one end portion thereof and in an axial direction of the sleeve portion.
Figure 6B:
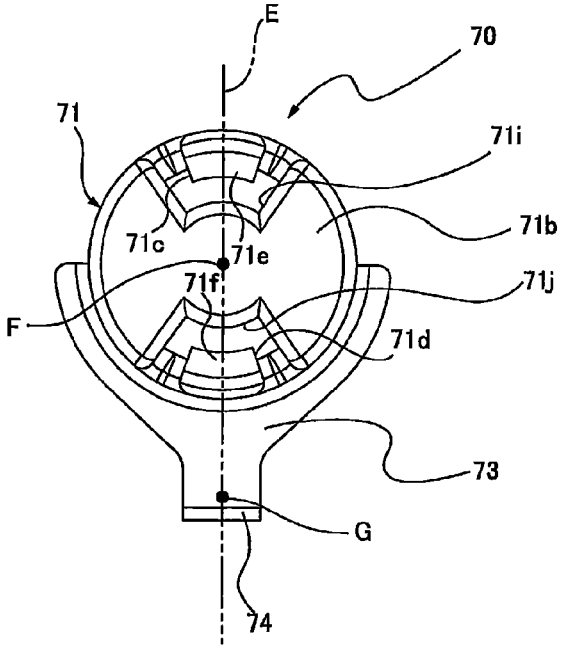
FIG. 6B is a view of the fixing member as viewed from another end portion thereof and in the axial direction of the sleeve portion.

As shown in FIGS. 6A and 6B, the pair of first contact portions 72*a*, 72*a* is symmetrically positioned with respect to an imaginary line E connecting a center F of the fitting portion 71 and a center G of the fixing portion 74 as viewed from the tip end to the base end of the insert portion 72. Here, the center G is located between a center of the fixing portion 74 in a direction of the line VIIA-VIIA shown in FIG. 4, and also a center of the fixing portion 74 in a widthwise direction thereof, i.e., in a direction perpendicular to the direction of the line VIIA-VIIA and to the axial direction of the sleeve portion 71*a*. Further, the first engagement protrusion 71*c*, the second engagement protrusion 71*d*, the insert portion 72, and the fixing portion 74 are respectively symmetrical with respect to the imaginary line E as viewed from the tip end to the base end of the insert portion 72.

As shown in FIG. 7A, upon engagement of the first and second engagement pawls 71*e* and 71*f* with the engagement groove 28*c*, each fixing member 70 is attached to each shaft end portion 28*b* of the positioning shaft 28.

The supported portion 28*a* and the insert portion 72 extend through the through-hole 57 of the positioning side plate 51, and the fixing portion 74 is engaged with the engagement portion 58 of the positioning shaft 28.

As shown in FIG. 8, one of the first contact portions 72*a* of the insert portion 72 is in abutment with the upper inner surface portion 57*a* and remaining one of the first contact portions 72*a* is in abutment with the front inner surface portion 57*c* of the through-hole 57. Further, the second contact portion 72*b* is in abutment with a peripheral surface of the supported portion 28*a* of the positioning shaft 28.

The supported portion 28*a* of the positioning shaft 28 is in abutment with the lower inner surface portion 57*e* and the diagonally upper rear inner surface portion 57*h*.

5. Assemblage of Positioning Mechanism

The positioning mechanism is assembled in the following manner. First, the fixing member 70 is attached to one of the end portions of the positioning shaft 28, for example, a right end portion. In the attachment, the first and second engagement pawls 71*e*, 71*f* are engaged with the engagement groove 28*c* at the right end portion of the positioning shaft 28 as shown in FIG. 7A.

Figure 9:
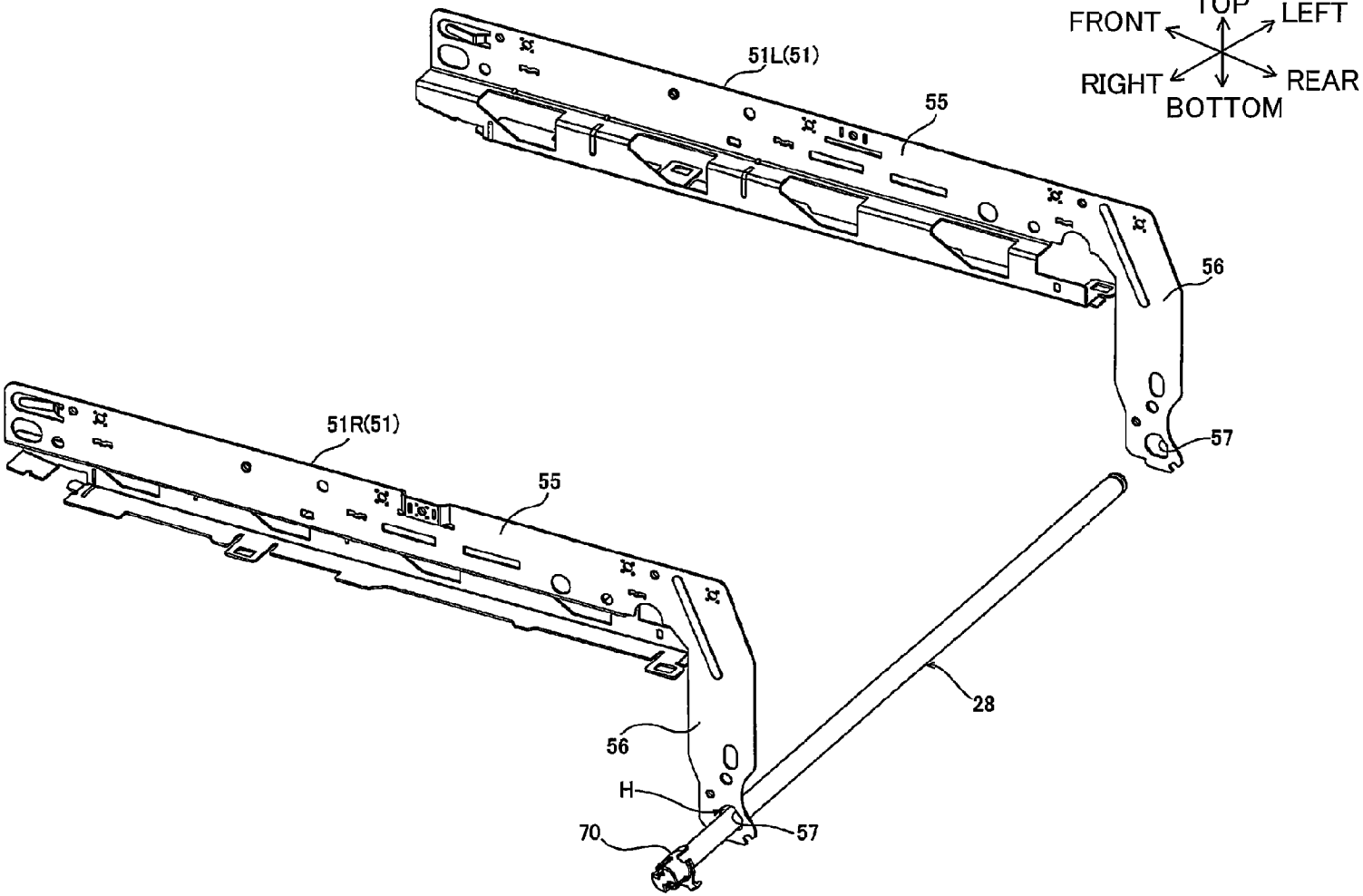
FIG. 9 is a perspective view of the positioning mechanism for description of assemblage.

Then, the left end portion of the positioning shaft 28 is inserted into the through-hole 57 of the right positioning side plate 51R, and the positioning shaft 28 is moved leftward such that the left end portion of the positioning shaft 28 is positioned rightward of the through-hole 57 of the left positioning side plate 51L as shown in FIG. 9.

Then, the positioning shaft 28 is further moved leftward such that the left end portion of the positioning shaft 28 passes through the through-hole 57 of the left positioning side plate 51L and is positioned leftward thereof. In this case, the positioning shaft 28 can be easily inserted through the through-hole 57 because a gap H (see FIG. 10A) is provided between the positioning shaft 28 and the inner surface of the through-hole 57, facilitating assembly work.

As described above, in the positioning shaft 28, the portion that is just inserted through the through-hole 57 is the supported portion 28*a*, and the portion positioned leftward of the supported portion 28*a* is the shaft end portion 28*b*.

Then, another fixing member 70 is positioned leftward of the positioning shaft 28 such that the insert portion 72 is aligned with the gap H and the fixing portion 74 is aligned with the engagement portion 58 of the left positioning side plate 51L.

Figure 10A:
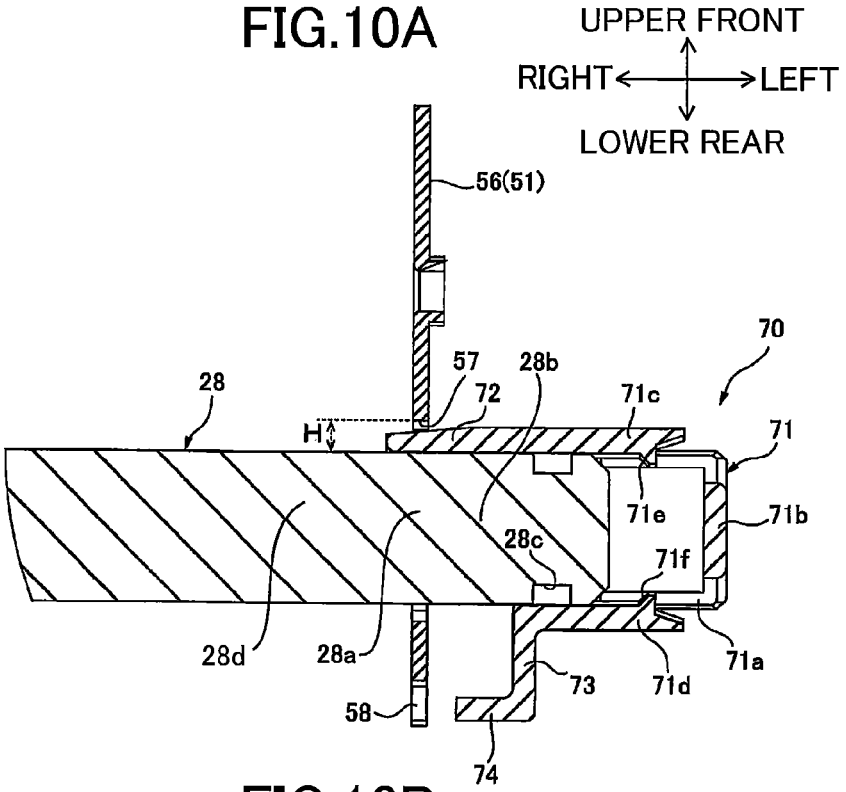
FIG. 10A is a cross-sectional view of the positioning mechanism for description of an initial phase of assemblage of the fixing member to a positioning shaft and showing a state where first and second engagement protrusions are positioned spaced away from an engagement groove.

Then, as shown in FIG. 10A, upon moving the fixing member 70 rightward with respect to the left positioning side plate 51L, the tip end of the insert portion 72 is guided into the through-hole 57, so that the insert portion 72 is positioned at the gap H.

Figure 10B:
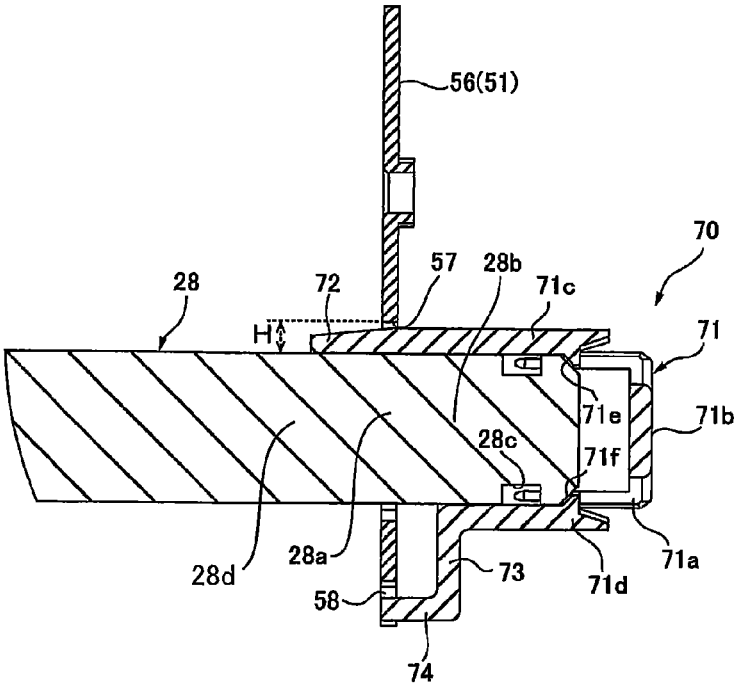
FIG. 10B is a cross-sectional view of the positioning mechanism for description of an intermediate phase of assemblage of the fixing member to the positioning shaft and showing a state where the first and second engagement protrusions are positioned close to the engagement groove.

Upon further rightward movement of the fixing member 70, the first and second engagement pawls 71*e*, 71*f* are positioned leftward of the engagement groove 28*c* as shown in FIG. 10B.

Upon further rightward movement of the fixing member 70, the first and second engagement pawls 71*e*, 71*f* are brought into engagement with the engagement groove 28*c* as shown in FIG. 7A, thereby completing attachment of the fixing member 70 to the shaft end portion 28*b*.

In this attachment state, the restriction portion 73 is in abutment with the positioning side plate 51, thereby restricting rightward movement of the fixing member 70. Further, the fixing portion 74 is engaged with the engagement portion 58. Accordingly, positioning of the fixing member 70 relative to the positioning shaft in its circumferential direction is attained.

As shown in FIG. 8, one of the first contact portions 72*a* of the insert portion 72 is in abutment with the upper inner surface portion 57*a*, and remaining one of the first contact portions 72*a* is in abutment with the front inner surface portion 57*c*. Therefore, the insert portion 72 is moderately deformed or flexed in a cantilevered manner where the base end of the insert portion 72 functions as a fulcrum. As a result, the second contact portion 72*b* presses the supported portion 28*a* toward the lower inner surface portion 57*e* and the rear inner surface portion 57*g* of the through-hole 57.

6. Pushing Operation to the Drawer Unit 12

When the drawer unit 12 positioned at the outside position is moved rearward to the inside position, the left abutment portion 41*a* of the left side plate 41 and the right abutment portion 42*a* of the right side plate 42 of the drawer unit 12 are brought into abutment with the left and right shaft abutment portions 28*d* of the positioning shaft 28, respectively. Thus, further rearward movement of the drawer unit 12 is prevented, and the drawer unit 12 is subjected to positioning in the main casing 2.

7. Function and Effect (1) According to the printer 1 and the positioning mechanism 15, the insert portion 72 presses the supported portion 28*a* against the lower inner surface portion 57*e* and rear inner surface portion 57*g*, and the gap H between the supported portion 28*a* and the upper, the diagonally upper front, and the front inner surface portions 57*a*, 57*b*, 57*c* is occupied by the insert portion 72. As a result, rattling of the positioning shaft 28 relative to the positioning side plates 51 can be restrained, and secure positioning of the drawer unit 12 in abutment with the positioning shaft 28 can be performed. Further, since the gap H is initially provided between the positioning shaft 28 and the through-hole 57, insertion of the positioning shaft 28 into the through-hole 57 can be facilitated resulting in easy assembling work.

(2) Further, according to the printer 1 and the positioning mechanism 15, the insert portion 72 can fill up the gap H between the supported portion 28*a* and the upper, the diagonally upper front, and the front inner surface portions 57*a*, 57*b*, 57*c*. Further, stabilized urging of the supported portion 28*a* toward the lower inner surface portion 57*e* and the rear inner surface portion 57*g* can be provided by the second contact portion 72*b*.

(3) Further, according to the printer 1 and the positioning mechanism 15, efficient urging of the supported portion 28*a* toward the lower inner surface portion 57*e* and the rear inner surface portion 57*g* can be provided, since the pair of first contact portions 72*a* and the second contact portion 72*b* is provided at the insert portion 72.

(4) Further, according to the printer 1 and the positioning mechanism, well-balanced urging of the supported portion 28*a* toward the lower inner surface portion 57*e* and the rear inner surface portion 57*g* can be provided by the positioning mechanism 15, since the second contact portion 72*b* is positioned at a center between the pair of first contact portions 72*a*.

(5) Further, according to the printer 1 and the positioning mechanism 15, the midway portion of the insert portion 72 can be bent or flexed with the base end of the insertion portion 72 functioning as the fulcrum. Therefore, stable contact of the pair of first contact portions 72*a* with the upper inner surface portion 57*a* and the front inner surface portion 57*c* can be provided, and stable contact of the second contact portion 72*b* with the supported portion 28*a* can be provided.

(6) Further, according to the printer 1 and the positioning mechanism 15, the restriction portion 73 can provide stable contact of one of the pair of first contact portions 72*a* with the upper inner surface portion 57*a*, and stable contact of remaining one of the pair of first contact portions 72*a* with the front inner surface portion 57*c*.

(7) Further, according to the printer 1 and the positioning mechanism 15, the insert portion 72 has the inclined portion 72*c* inclined toward the radial center of the sleeve portion 71*a* with the increasing distance from the upper, the diagonally upper front, and the front inner surface portions 57*a*, 57*b*, 57*c*. Therefore, insertion of the insert portion 72 into the through-hole 57 can be facilitated.

(8) Further, according to the printer 1 and the positioning mechanism 15, disengagement of the fixing member 70 from the shaft end portion 28*b* can be restrained because of engagement of the first and second engagement pawls 71*e*, 71*f* with the engagement groove 28*c*.

(9) Further, according to the printer 1 and the positioning mechanism 15, the fixing member 70 has the fixing portion 74 permitting the insert portion 72 to be positioned at a fixed position in the circumferential direction of the sleeve portion 71*a*. Therefore, the insert portion 72 can be stably positioned between the supported portion 28*a* and the upper, diagonally upper front and front inner surface portions 57*a*, 57*b*, 57*c*. As a result, secure abutment of the supported portion 28*a* with the upper inner surface portion 57*a* and the front inner surface portion 57*c* can be provided.

10) Further, according to the printer 1 and the positioning mechanism 15, the pair of first contact portions 72*a*, 72*a* is positioned symmetrical with respect to the imaginary line connecting the center of the fitting portion 71 and the center of the fixing portion 74 as viewed from the tip end to the base end of the insert portion 72 (when projected in the axial direction of the sleeve portion 71*a*). Therefore, high versatility or utility of the fixing member 70 can be provided. That is, fixing members identical to each other can be used at each end portion 28*b* of the positioning shaft 28.

8. Modifications

According to the above-described embodiment, the second contact portion 72*b* is provided at the insert portion 72. However, the fitting portion 71 can provide a second contact portion 71*l* as shown in FIG. 12.

Figure 11:
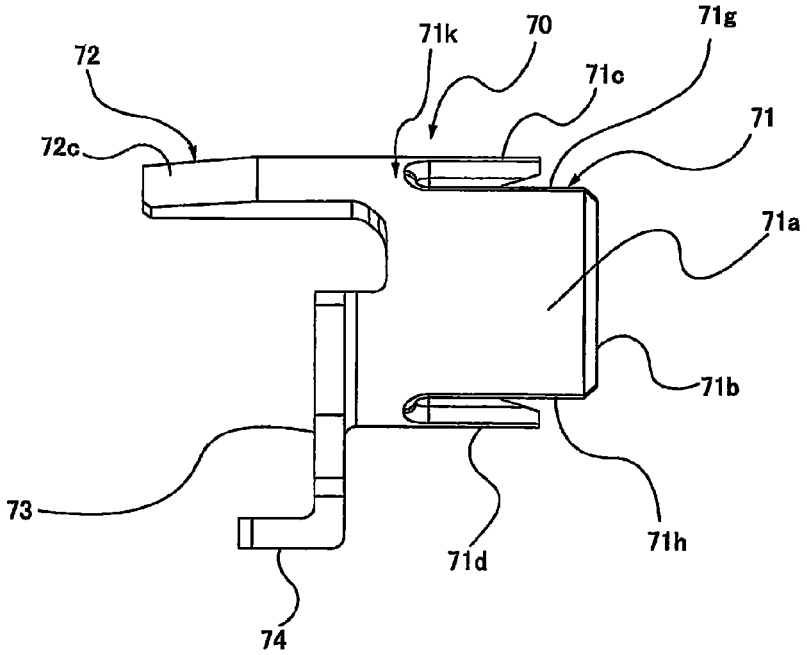
FIG. 11 is a view of a fixing member including a sleeve portion according to a modified embodiment as viewed in a direction perpendicular to an axial direction of the sleeve portion.
Figure 12:
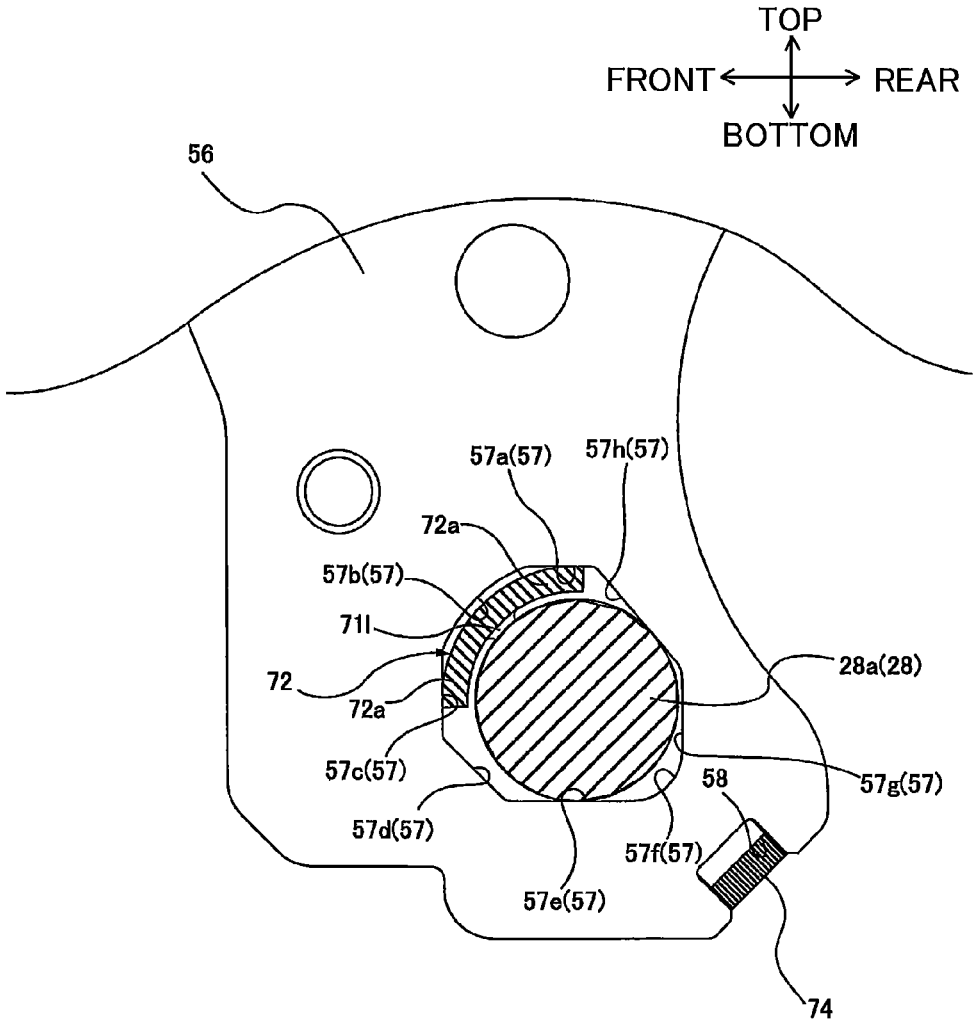
FIG. 12 is a partial cross-sectional view of a positioning mechanism taken along the line XII-XII of FIG. 3 according to the modified embodiment, and showing a state where the fixing member is attached to the positioning shaft.

More specifically, the sleeve portion 71*a* can be provided with a sleeve end portion 71*k* and the second contact portion 71*l* as shown in FIGS. 11 and 12.

The sleeve end portion 71*k* is a part of the other end portion of the sleeve portion 71*a*, and is aligned with the insert portion 72 when viewing from the tip end to the base end of the insert portion 72.

The second contact portion 71*l* protrudes inward from an inner surface the sleeve portion 71*a* and at the sleeve end portion 71*k*.

Further, as described above, each first contact portion 72*a* is positioned at each end portion of the insert portion 72 in the circumferential direction of the supported portion 28*a*.

The sleeve portion 71*a* is bent or flexed with the base end portion of the insert portion 72 functioning as a fulcrum upon positioning the insert portion 72 between the supported portion 28*a* and the upper, diagonally upper front, and front inner surfaces 57*a*, 57*b*, 57*c*. As a result, the second contact portion 71*l* presses the positioning shaft 28 at a position adjacent the supported portion 28*a* toward the lower inner surface portion 57*e* and the rear inner surface portion 57*g*.

With this structure, the positioning shaft 28 portion positioned adjacent to the supported portion 28*a* can be pressed toward the lower inner surface portion 57*e* and the rear inner surface portion 57*g* by the second contact portion 71*l* provided at the sleeve portion 71*a*.

Further, the first contact portions 72*a* can be contacted with the upper inner surface portion 57*a* and the front inner surface portion 57*c* in a well-balanced manner.

According to a further modification, the insert portion 72 can be provided with an additional first contact portion (not shown). More specifically, the additional first contact portion can protrude toward the diagonally upper front inner surface portion 57*b* in alignment with an imaginary line connecting the center of the fitting portion 71 and the center of the fixing portion 74 when projected in the axial direction of the fitting portion 71.

With this structure, the first contact portion can be positioned in a well-balanced manner at the insert portion 72. As a result, stabilized contact of the first contact portion with the diagonally upper front inner surface portion 57*b* can be obtained.

While the invention has been described in detail with reference to the above-described embodiments thereof, it would be apparent to those skilled in the art that various changes and modifications may be made therein without departing from the spirit of the invention.

What is claimed is:

1. An image forming device comprising:

a main casing;

a unit for image formation;

a side plate fixed in the main casing and positioned spaced away from the unit in a first direction, the side plate being formed with a through-hole having a first surface linearly extending in a second direction crossing the first direction, a second surface linearly extending in a third direction crossing the first direction and the second direction, a third surface, and a fourth surface positioned between the first surface and the second surface in a contour of the through hole;

a positioning member extending in the first direction and comprising a first portion inserted through the through-hole and a second portion configured to be in abutment with the unit, the first portion being in contact with the first surface and the second surface, and the third surface being positioned opposite to the fourth surface with respect to the first portion; and a fixing member comprising an insert portion configured to be inserted through the through-hole, the insert portion being positioned between the first portion and the third surface to press the first portion toward the fourth surface.

2. The image forming device as claimed in claim 1, wherein the unit is a process unit configured to be mounted on the main casing and having a photosensitive drum.

3. The image forming device as claimed in claim 1, wherein the insert portion is provided with a first contact portion in contact with the third surface, and wherein the fixing member further comprises a second contact portion in contact with the positioning member, the second contact portion pressing the first portion toward the fourth surface in a state where the insert portion is positioned between the first portion and the third surface.

4. The image forming device as claimed in claim 3, wherein the insert portion is provided with the second contact portion.

5. The image forming device as claimed in claim 4, wherein the first contact portion comprises two contact portions each positioned at each end portion of the insert portion in a circumferential direction of the first portion, and wherein the second contact portion is positioned at a center position between the two contact portions in the circumferential direction.

6. The image forming device as claimed in claim 3, wherein the positioning member further comprises a third portion continuous with the first portion, wherein the fixing member further comprises a fitting portion fitted with the third portion, the insert portion extending from the fitting portion in the first direction to define a base end portion and a free end portion, and wherein the first contact portion is positioned midway between the base end portion and the free end portion in the first direction.

7. The image forming device as claimed in claim 3, wherein the positioning member further comprises a third portion continuous with the first portion, and wherein the fixing member further comprises a fitting portion fitted with the third portion, the insert portion extending from the fitting portion in the first direction, the fitting portion being provided with the second contact portion, and the insert portion being provided with the first contact portion.

8. The image forming device as claimed in claim 7, wherein the first contact portion comprises two contact portions each positioned at each end portion of the insert portion in a circumferential direction of the first portion.

9. The image forming device as claimed in claim 3, wherein the fixing member further comprises a restriction portion in abutment with the side plate to restrict movement of the fixing member in the first direction for maintaining contact of the first contact portion with the third surface.

10. The image forming device as claimed in claim 1, wherein the insert portion has a base end portion and a free end portion, and is inclined in a direction away from the third surface with distance from the base end portion.

11. The image forming device as claimed in claim 1, wherein the fixing member further comprises a first engagement portion, and wherein the positioning member has a second engagement portion engaged with the first engagement portion.

12. The image forming device as claimed in claim 1, wherein the fixing member further comprises a fixing portion to position the insert portion at a given position in a circumferential direction of the positioning member.

13. The image forming device as claimed in claim 12, wherein the insert portion is provided with a plurality of first contact portions in contact with the third surface and arrayed in a circumferential direction of the first portion, wherein the positioning member further comprises a third portion continuous with the first portion, wherein the fixing member further comprises a fitting portion fitted with the third portion, and wherein the plurality of first contact portions is symmetrically positioned with respect to an imaginary line connecting a center of the fitting portion and a center of the fixing portion in a projection view in the first direction.

14. The image forming device as claimed in claim 12, wherein the insert portion is provided with a first contact portion in contact with the third surface, wherein the positioning member further comprises a third portion continuous with the first portion, and wherein the fixing member further comprises a fitting portion fitted with the third portion, the first contact portion being positioned on an imaginary line connecting a center of the fitting portion and a center of the fixing portion in a projection view in the first direction.

15. A positioning mechanism configured to perform positioning of a unit for image formation relative to a main casing, the positioning mechanism comprising:

a side plate fixed in the main casing and positioned spaced away from the unit in a first direction, the side plate being formed with a through-hole having a first surface linearly extending in a second direction crossing the first direction, a second surface linearly extending in a third direction crossing the first direction and the second direction, a third surface, and a fourth surface positioned between the first surface and the second surface in a contour of the through hole;

a positioning member extending in the first direction and comprising a first portion inserted through the through-hole and a second portion configured to be in abutment with the unit, the first portion being in contact with the first surface and the second surface, and the third surface being positioned opposite to the fourth surface with respect to the first portion; and a fixing member comprising an insert portion configured to be inserted through the through-hole, the insert portion being positioned between the first portion and the third surface to press the first portion toward the fourth surface.

16. The positioning mechanism as claimed in claim 15, wherein the insert portion is provided with a first contact portion in contact with the third surface, and wherein the fixing member further comprises a second contact portion in contact with the positioning member, the second contact portion pressing the first portion toward the fourth surface in a state where the insert portion is positioned between the first portion and the third surface.

17. The positioning mechanism as claimed in claim 16, wherein the insert portion is provided with the second contact portion.

18. The positioning mechanism as claimed in claim 17, wherein the first contact portion comprises two contact portions each positioned at each end portion of the insert portion in a circumferential direction of the first portion, and wherein the second contact portion is positioned at a center position between the two contact portions in the circumferential direction.

19. The positioning mechanism as claimed in claim 16, wherein the positioning member further comprises a third portion continuous with the first portion, wherein the fixing member further comprises a fitting portion fitted with the third portion, the insert portion extending from the fitting portion in the first direction to define a base end portion and a free end portion, and wherein the first contact portion is positioned midway between the base end portion and the free end portion in the first direction.

20. The positioning mechanism as claimed in claim 16, wherein the positioning member further comprises a third portion continuous with the first portion, and wherein the fixing member further comprises a fitting portion fitted with the third portion, the insert portion extending from the fitting portion in the first direction, the fitting portion being provided with the second contact portion, and the insert portion being provided with the first contact portion.

21. The positioning mechanism as claimed in claim 20, wherein the first contact portion comprises two contact portions each positioned at each end portion of the insert portion in a circumferential direction of the first portion.

22. The positioning mechanism as claimed in claim 16, wherein the fixing member further comprises a restriction portion in abutment with the side plate to restrict movement of the fixing member in the first direction for maintaining contact of the first contact portion with the third surface.

23. The positioning mechanism as claimed in claim 15, wherein the insert portion has a base end portion and a free end portion, and is inclined in a direction away from the third surface with distance from the base end portion.

24. The positioning mechanism as claimed in claim 15, wherein the fixing member further comprises a first engagement portion, and wherein the positioning member has a second engagement portion engaged with the first engagement portion.

25. The positioning mechanism as claimed in claim 15, wherein the fixing member further comprises a fixing portion to position the insert portion at a given position in a circumferential direction of the positioning member.

26. The positioning mechanism as claimed in claim 25, wherein the insert portion is provided with a plurality of first contact portions in contact with the third surface and arrayed in a circumferential direction of the first portion, wherein the positioning member further comprises a third portion continuous with the first portion, wherein the fixing member further comprises a fitting portion fitted with the third portion, and wherein the plurality of first contact portions is symmetrically positioned with respect to an imaginary line connecting a center of the fitting portion and a center of the fixing portion in a projection view in the first direction.

27. The positioning mechanism as claimed in claim 25, wherein the insert portion is provided with a first contact portion in contact with the third surface, wherein the positioning member further comprises a third portion continuous with the first portion, and wherein the fixing member further comprises a fitting portion fitted with the third portion, the first contact portion being positioned on an imaginary line connecting a center of the fitting portion and a center of the fixing portion in a projection view in the first direction.

* * * * *